US010147590B2

(12) United States Patent
Hizume et al.

(10) Patent No.: US 10,147,590 B2
(45) Date of Patent: Dec. 4, 2018

(54) MASS SPECTROMETRY DATA PROCESSING APPARATUS AND MASS SPECTROMETRY DATA PROCESSING METHOD

(71) Applicant: JEOL Ltd., Tokyo (JP)

(72) Inventors: Takuhiro Hizume, Tokyo (JP); Takaya Satou, Tokyo (JP)

(73) Assignee: JEOL Ltd., Tokyo (JP)

( * ) Notice: Subject to any disclaimer, the term of this patent is extended or adjusted under 35 U.S.C. 154(b) by 276 days.

(21) Appl. No.: 14/994,444

(22) Filed: Jan. 13, 2016

(65) Prior Publication Data

US 2016/0225595 A1 Aug. 4, 2016

(30) Foreign Application Priority Data

Jan. 16, 2015 (JP) ..... 2015-006705

(51) Int. Cl.
*H01J 49/00* (2006.01)

(52) U.S. Cl.
CPC ..... *H01J 49/0036* (2013.01); *H01J 49/0004* (2013.01)

(58) Field of Classification Search
CPC ..... H01J 49/0036; H01J 49/0004
USPC ..... 702/199
See application file for complete search history.

(56) References Cited

U.S. PATENT DOCUMENTS 5,352,891 A * 10/1994 Monnig ..... H01J 49/0036 250/282
8,428,889 B2 * 4/2013 Wright ..... G01J 3/28 702/32
8,873,796 B2 * 10/2014 Kajihara ..... H01J 49/0036 382/100
8,935,101 B2 * 1/2015 Wright ..... G01N 30/8675 250/281
2009/0199620 A1 * 8/2009 Kawana ..... G01N 30/8603 73/23.37
2010/0158385 A1 * 6/2010 Jeung ..... G01N 23/087 382/191
2011/0127425 A1 6/2011 Kajihara
(Continued)

FOREIGN PATENT DOCUMENTS

JP 2011191222 A 9/2011
JP 5206790 B2 3/2013

*Primary Examiner* — Fernando L Toledo
*Assistant Examiner* — Adam S Bowen
(74) *Attorney, Agent, or Firm* — The Webb Law Firm

(57) ABSTRACT

A mass spectrometry data processing apparatus includes a data analysis unit that processes a mass spectrum of each of analysis-target areas within a two-dimensional range set on a sample. The data analysis unit obtains a plurality of mass spectra each associated with position information of a corresponding one of the analysis-target areas; creates an average mass spectrum that is an average of the plurality of obtained mass spectra; extracts, for each mass range, a highest peak by comparing the plurality of obtained mass spectra with one another, and creates a maximum mass spectrum constituted by the extracted highest peaks; creates an intensity ratio spectrum indicating an intensity ratio of the average mass spectrum to the maximum mass spectrum; and selects a peak in a range of a threshold set for the intensity ratio spectrum and specifies a mass range including the peak.

5 Claims, 5 Drawing Sheets

(56) References Cited

U.S. PATENT DOCUMENTS

2011/0216952 A1* 9/2011 Kajihara ..... G06K 9/00
382/128
2014/0316717 A1* 10/2014 Ikegami ..... H01J 49/0004
702/23

* cited by examiner

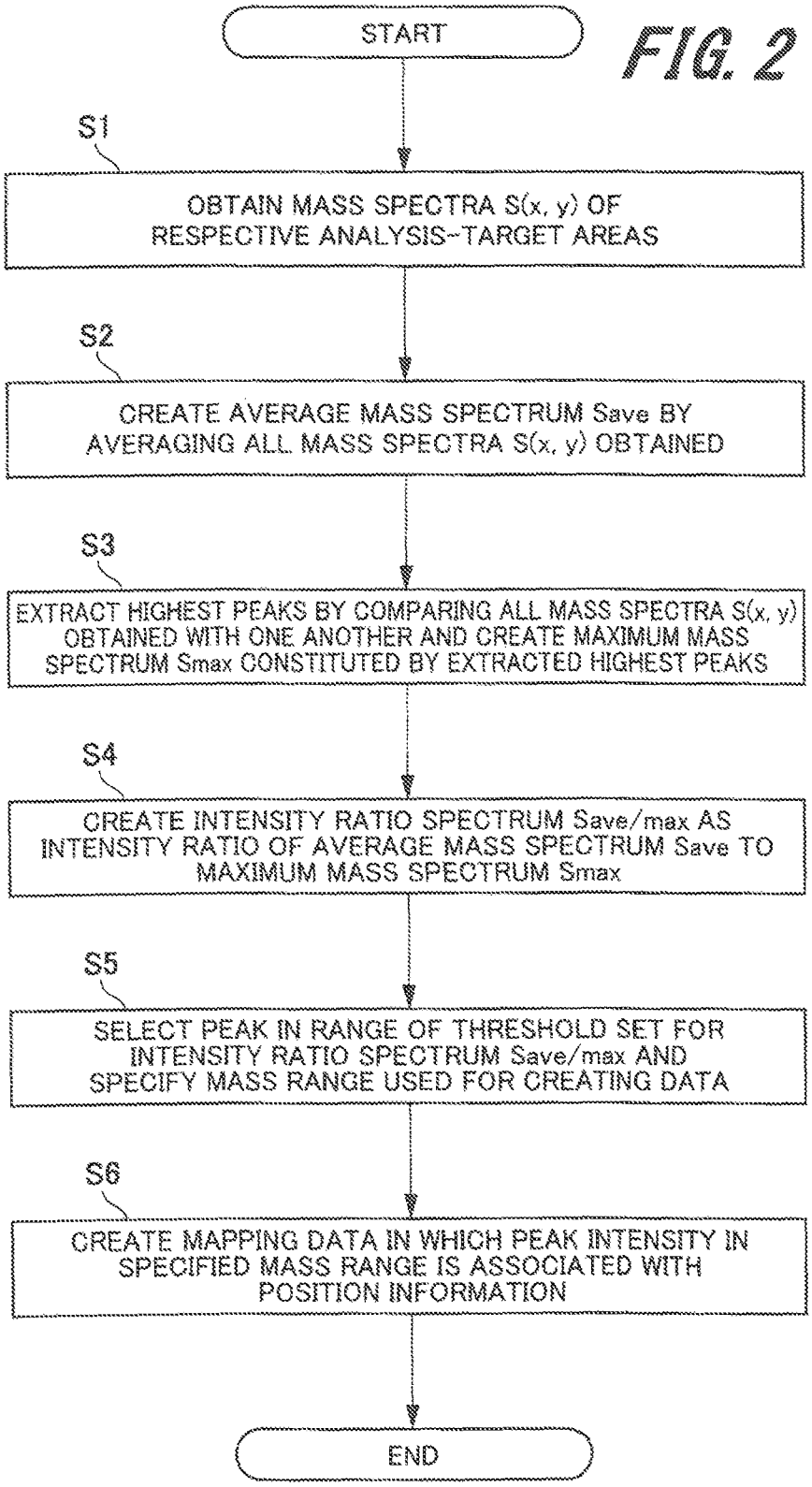
START
FIG. 2
S1
OBTAIN MASS SPECTRA S(x, y) OF RESPECTIVE ANALYSIS-TARGET AREAS
S2
CREATE AVERAGE MASS SPECTRUM Save BY AVERAGING ALL MASS SPECTRA S(x, y) OBTAINED
S3
EXTRACT HIGHEST PEAKS BY COMPARING ALL MASS SPECTRA S(x, y) OBTAINED WITH ONE ANOTHER AND CREATE MAXIMUM MASS SPECTRUM Smax CONSTITUTED BY EXTRACTED HIGHEST PEAKS
S4
CREATE INTENSITY RATIO SPECTRUM Save/max AS INTENSITY RATIO OF AVERAGE MASS SPECTRUM Save TO MAXIMUM MASS SPECTRUM Smax
S5
SELECT PEAK IN RANGE OF THRESHOLD SET FOR INTENSITY RATIO SPECTRUM Save/max AND SPECIFY MASS RANGE USED FOR CREATING DATA
S6
CREATE MAPPING DATA IN WHICH PEAK INTENSITY IN SPECIFIED MASS RANGE IS ASSOCIATED WITH POSITION INFORMATION
END

MASS SPECTROMETRY DATA PROCESSING APPARATUS AND MASS SPECTROMETRY DATA PROCESSING METHOD

BACKGROUND OF THE INVENTION

Field of the Invention

The present invention relates to a mass spectrometry data processing apparatus and a mass spectrometry data processing method for use in two-dimensional mass spectrometry.

Description of Related Art

In two-dimensional mass spectrometry using a mass spectrometer, distribution information (mass imaging) of ions having a certain mass range can be obtained by analyzing a plurality of pieces of mass spectrometry data (i.e., mass spectra) each associated with position information of a corresponding position on a sample. The mass range is specified, for example, in the following manner. First, mass spectrometry is performed for individual micro areas within a certain two-dimensional range set on a sample to collect mass spectra. Then, an operator selects a substance of interest, that is, a mass range (see, for example, Japanese Patent No. 5206790).

In addition, the following method is disclosed as a data processing method for mass spectra in two-dimensional mass spectrometry. Specifically, a peak having the highest signal intensity, which is highly likely to indicate the most common substance, is searched for in a mass spectrum of each of micro areas. Then, the largest value is determined from among the retrieved highest signal intensities. A color scale for displaying the intensity is defined to correspond to a range from zero to the largest value. A display color corresponding to the highest signal intensity is determined for each micro area in accordance with the color scale. A colored two-dimensional image of the entirety or part of the two-dimensional range is created and displayed in a display window. Each micro area that contains a noticeable amount of substance is clearly shown in the colored two-dimensional image (mass spectrometric mapping image) regardless of the kind of peak, that is, the kind of substance in the mass spectrum of the micro area (see, Japanese Unexamined Patent Application Publication No. 2011-191222).

Because a mass spectrum is measured at many positions in two-dimensional mass spectrometry for mass imaging in order to improve the position resolution, measurement time taken for a mass spectrum (i.e., number of acquisitions) is limited. For this reason, each mass spectrum has a low signal-to-noise ratio (S/N). In addition, spike noise having a high peak intensity is sometimes detected. On the other hand, a peak corresponding to a locally present substance to be analyzed is sometimes not so high.

When no substance to be analyzed is specified, a mass range needs to be specified by selecting peaks to be focused on from among various peaks including spike noise in a vast number of mass spectra. Such a procedure is not only very laborious but also sometimes fails to find the mass range supposed to be analyzed.

SUMMARY OF THE INVENTION

Accordingly, it is an object of the present invention to provide a mass spectrometry data processing apparatus and a mass spectrometry data processing method that make it possible to easily select a peak to be focused on from a plurality of mass spectra obtained by two-dimensional mass spectrometry.

To this end, according to an aspect of the present invention, there is provided a mass spectrometry data processing apparatus including a data analysis unit that processes a mass spectrum of each of analysis-target areas within a two-dimensional range set on a sample. The data analysis unit obtains a plurality of mass spectra each associated with position information of a corresponding one of the analysis-target areas; creates an average mass spectrum that is an average of the plurality of obtained mass spectra; extracts, for each mass range, a highest peak by comparing the plurality of obtained mass spectra with one another, and creates a maximum mass spectrum constituted by the extracted highest peaks; creates an intensity ratio spectrum indicating an intensity ratio of the average mass spectrum to the maximum mass spectrum; and selects a peak in a range of a threshold set for the intensity ratio spectrum and specifies a mass range including the peak.

According to such an aspect of the present invention, it becomes possible to easily select a peak to be focused on from a plurality of mass spectra obtained by two-dimensional mass spectrometry.

BRIEF DESCRIPTION OF THE DRAWINGS

FIG. 2 is a flowchart illustrating a mass spectrometry data processing method that is carried out by the mass spectrometry data processing apparatus according to the embodiment.

DESCRIPTION OF THE INVENTION

A mass spectrometry data processing apparatus and a mass spectrometry data processing method according to an embodiment of the present invention will be described in detail below with reference to the accompanying drawings.

Mass Spectrometry Data Processing Apparatus

Figure 1:
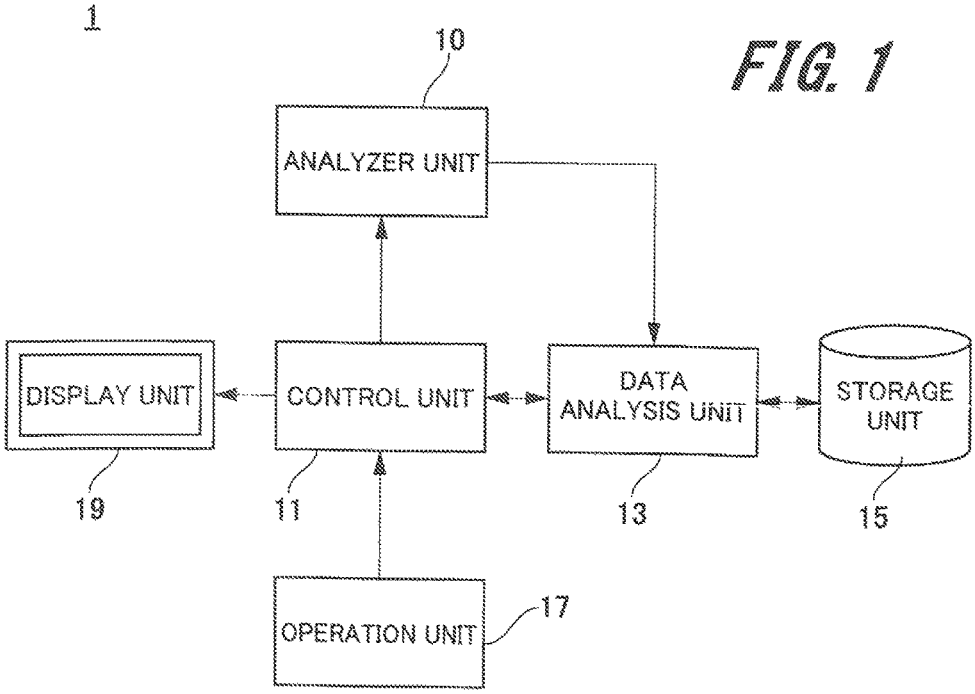
FIG. 1 is a configuration diagram illustrating the overview of a mass spectrometry apparatus including a mass spectrometry data processing apparatus according to an embodiment of the present invention.

FIG. 1 is a configuration diagram illustrating the overview of a mass spectrometry apparatus 1 including a mass spectrometry data processing apparatus according to an embodiment of the present invention. The mass spectrometry apparatus 1 illustrated in FIG. 1 performs two-dimensional mass spectrometry in which mass spectrometry is performed for each analysis-target area within a two-dimensional range set on a sample. The mass spectrometry data processing apparatus included in this mass spectrometry apparatus 1 carries out a mass data processing method for obtaining distribution information of ions having a certain mass range for the two-dimensional range set on the sample.

The mass spectrometry apparatus 1 includes an analyzer unit 10, a control unit 11, a data analysis unit 13, a storage unit 15, an operation unit 17, and a display unit 19. From among these components, the data analysis unit 13 constitutes a major part of the mass spectrometry data processing apparatus. Details of these components will be described below.

[Analyzer Unit 10]

The analyzer unit 10 is a unit that ionizes a sample, separates the resulting ions according to their mass-to-charge ratios (m/z), and detects the individual ions. The analyzer unit 10 includes an ion source, a mass analyzer, and a detector. The analyzer unit 10 particularly includes a stage driver that highly precisely moves a stage on which a sample to be analyzed is mounted, in directions of two axes of x and y. Such a configuration allows the analyzer unit 10 to perform mass spectrometry for individual analysis-target areas within a given two-dimensional range set on a sample and to collect mass spectra.

As the analyzer unit 10 thus configured, for example, a mass spectrometer that ionizes a sample by using Matrix Assisted Laser Desorption/Ionization (MALDI) and separates and detects ionized substances according to their mass-to-charge ratios (m/z) by using Time of Flight Mass Spectrometry (TOFMS) is employed.

[Control Unit 11]

The control unit 11 controls operations of the ion source, the mass analyzer, the detector, and the stage driver of the analyzer unit 10. The control unit 11 also constitutes a part of the mass spectrometry data processing apparatus.

[Data Analysis Unit (Mass Spectrometry Data Processing Apparatus) 13]

The data analysis unit 13 constitutes the major part of the mass spectrometry data processing apparatus. The data analysis unit 13 sequentially obtains signals detected by the analyzer unit 10 and converts the signals into a mass spectrum, which illustrates a relationship between the mass-to-charge ratio (m/z) and the detected intensity of the signals. The data analysis unit 13 also obtains, as position information of each analysis-target area within the two-dimensional range set on the sample, coordinates of the position of the stage from the control unit 11, for example. The data analysis unit 13 then associates with each other the position information of each analysis-target area and a mass spectrum obtained by mass spectrometry for the analysis-target area and causes the storage unit 15 to store the associated position information and mass spectrum.

Further, the data analysis unit 13 performs a process for extracting and displaying an intensity distribution of ions having a certain mass range, on the basis of a plurality of mass spectra each associated with the position information of the corresponding analysis-target area. In this embodiment, contents of this process are characteristic. Details of the contents of this process will be described below in relation to a mass spectrometry data processing method. Note that the data analysis unit 13 may be, for example, a general-purpose personal computer in which software for executing a procedure described in relation to the mass spectrometry data processing method below is installed.

[Storage Unit 15]

The storage unit 15 stores position information of each analysis-target area and the corresponding mass spectrum that are associated with each other by the data analysis unit 13. In addition, the storage unit 15 stores various kinds of data obtained through the process performed by the data analysis unit 13. The storage unit 15 also constitutes a part of the mass spectrometry data processing apparatus.

[Operation Unit 17]

The operation unit 17 is a unit used to input various settings related to mass spectrometry performed by the analyzer unit 10 and various settings related to a mass spectrometry data processing process performed by the data analysis unit 13. The various settings related to mass spectrometry include, for example, those related to the two-dimensional range for which mass spectrometry is performed, the number of areas into which the set two-dimensional range is divided, and time taken for analysis in one divisional area. In addition, the various settings related to a mass spectrometry data processing process include, for example, those related to a lower threshold and an upper threshold (described later). The operation unit 17 may be, for example, a keyboard or a touch-panel input unit integrally provided with the display unit 19.

[Display Unit 19]

The display unit 19 displays the various settings input with the operation unit 17 and a result of a mass spectrometry data analysis process performed by the data analysis unit 13. The display unit 19 also displays a microscopic image of the sample obtained with a microscope (not illustrated).

Mass Spectrometry Data Processing Method

FIG. 2 is a flowchart illustrating a mass spectrometry data processing method carried out by the data analysis unit 13 of the mass spectrometry apparatus 1 according to the embodiment. The mass spectrometry data processing method will be described below according to the flowchart of FIG. 2 with reference to FIG. 1 and other appropriate figures.

Figure 3:
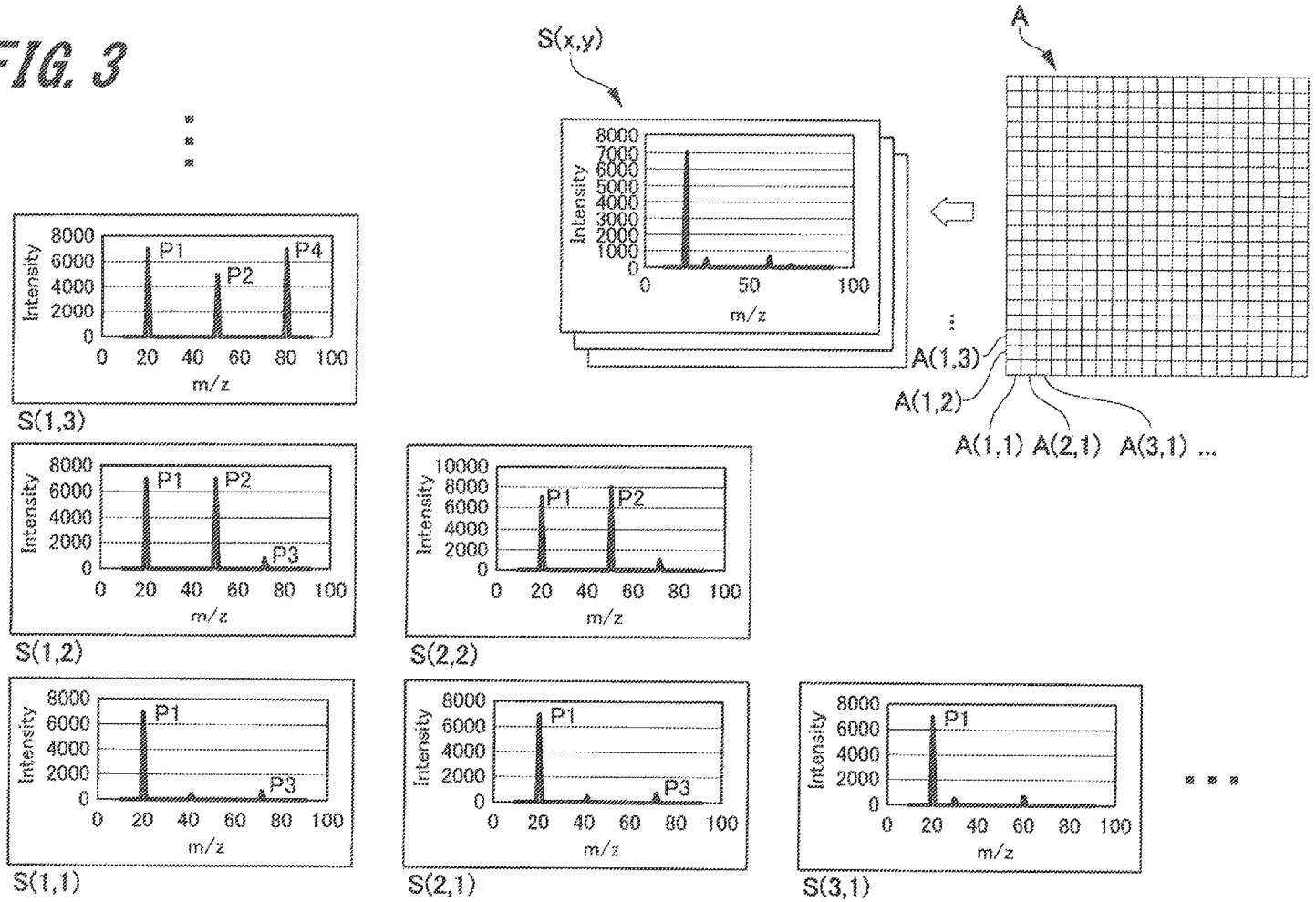
FIG. 3 is a diagram illustrating hypothetical mass spectra to be processed by the mass spectrometry data processing apparatus according to the embodiment of the present invention.

Prior to the mass spectrometry data processing process, the analyzer unit 10 performs mass spectrometry for each of analysis-target areas within a given two-dimensional range in response to operation of the operation unit 17. As illustrated in FIG. 3, a two-dimensional range A is divided into several hundreds to several tens of thousands of analysis-target areas A(x, y) each assigned position information (x, y) (where x=1, 2, . . . and y=1, 2, . . . ). The analyzer unit 10 sequentially performs mass spectrometry for each of these analysis-target areas A(x, y).

In parallel with the mass spectrometry, the data analysis unit 13 obtains the position information (x, y) of each of the analysis-target areas A(x, y) from the control unit 11, associates the position information (x, y) of each analysis-target area A(x, y) with a mass spectrum S(x, y) obtained as a result of mass spectrometry performed by the analyzer unit 10 for the analysis-target area A(x, y), and causes the storage unit 15 to store the associated position information (x, y) and mass spectrum S(x, y). The data analysis unit 13 then performs the mass spectrometry data processing process in the following manner.

Step S1

After the mass spectrometry has been completed, the data analysis unit 13 obtains the mass spectra S(x, y) each associated with the position information (x, y) of the corresponding analysis-target area A(x, y) in step S1. These mass spectra S(x, y) are a set S of original mass spectra obtained by the mass spectrometry. For example, peaks having the following characteristics appear in these original mass spectra S(x, y).

[Peak P1] A peak P1 appears strongly around a mass-to-charge ratio (m/z) of 20 in all the mass spectra S(x, y) illustrated in FIG. 3 and is highly likely to indicate a matrix of the sample.

[Peak P2] A peak P2 appears around a mass-to-charge ratio (m/z) of 50 in some mass spectra S(1, 2), S(2, 2), S(1, 3), . . . illustrated in FIG. 3, and its intensity is sometimes higher than that of the peak P1.

[Peak P3] A peak P3 appears around a mass-to-charge ratio (m/z) of 70 in some mass spectra S(1, 1), S(2, 1), S(1, 2) . . . illustrated in FIG. 3, and its intensity is low.

[Peak P4] A peak P4 appears around a mass-to-charge ratio (m/z) of 80 only in the mass spectrum S(1, 3) illustrated in FIG. 3, and its intensity is high. The peak P4 is highly likely to be spike noise that occurs very locally due to an electric factor of the apparatus.

In this case, it is desired to obtain distribution information by focusing on the peaks P2 and P3 that respectively appear around the mass-to-charge ratios (m/z) of 50 and 70 only in some mass spectra. However, in practical mass spectrometry, the mass spectra S(x, y) are obtained for several hundreds to several tens of thousands of analysis-target areas A(x, y). Therefore, there are too many mass spectra S(x, y), and it is difficult to select peaks to be focused on. Accordingly, data processing is performed in the following manner.

Step S2

Figure 4:
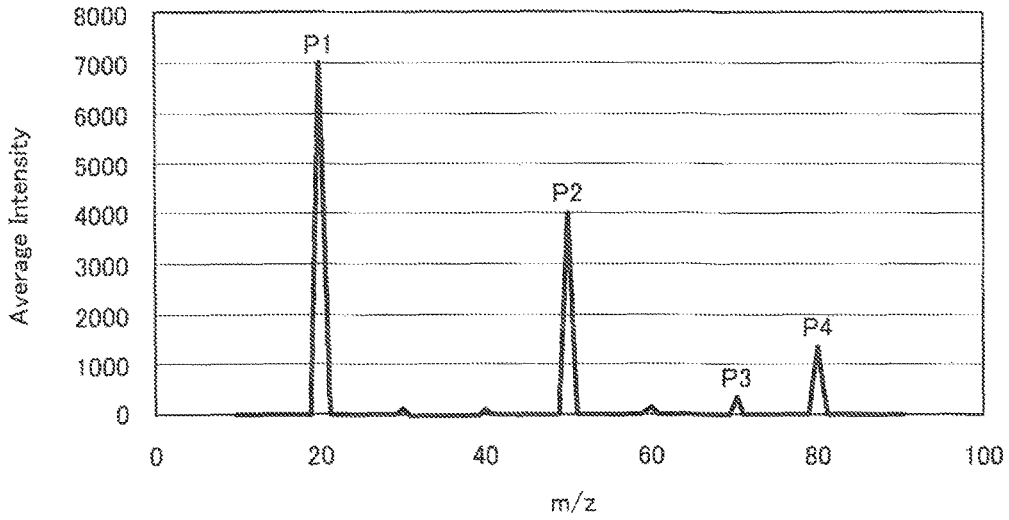
FIG. 4 is a diagram illustrating an average mass spectrum obtained by averaging all the mass spectra.

In step S2, the data analysis unit 13 creates an average mass spectrum Save by averaging all the obtained mass spectra S(x, y). FIG. 4 illustrates the resulting average mass spectrum Save. The average mass spectrum Save is an average of all the mass spectra S(x, y) in the set S of original mass spectra.

As illustrated in FIG. 4, in the average mass spectrum Save, the intensity of the peak P1 that appears in almost all the original mass spectra S(x, y) is relatively high, whereas the intensities of the peaks P2, P3, and P4 that appear only in some mass spectra S(x, y) are relatively low.

Step S3

Figure 5:
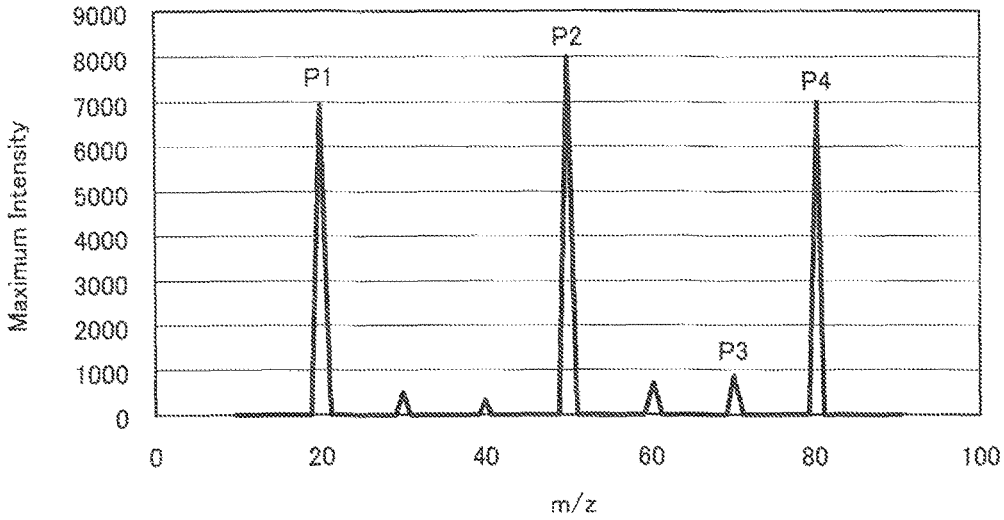
FIG. 5 is a diagram illustrating a maximum mass spectrum obtained by extracting, for each peak, the largest value from all the mass spectra and plotting the extracted largest values.

In step S3, the data analysis unit 13 compares all the obtained mass spectra S(x, y) with one another to extract the highest peak in each mass range and creates a maximum mass spectrum Smax constituted by the extracted highest peaks. This maximum mass spectrum Smax is a single spectrum constructed by using the highest peaks extracted from the respective mass ranges and is created by using the maximum pixel spectrum technique. Note that "mass range" herein refers to each range of the mass-to-charge ratio (m/z). FIG. 5 illustrates the resulting maximum mass spectrum Smax.

As illustrated in FIG. 5, in the maximum mass spectrum Smax, the peaks P1, P2, and P4, which have a high intensity in any of the original mass spectra S(x, y), maintain the high intensity. However, whether each of the peaks P1, P2, and P4 appears in almost all the original mass spectra S(x, y) or only in some of the original mass spectra S(x, y) is not distinguishable. In addition, the peak P3 originally having a low intensity still has a low intensity. Differences between the peak P3 and noise peaks located around mass-to-charge ratios (m/z) of 30, 40, and 60 are not apparent. Note that step S3 may be performed before step S2.

Step S4

Figure 6:
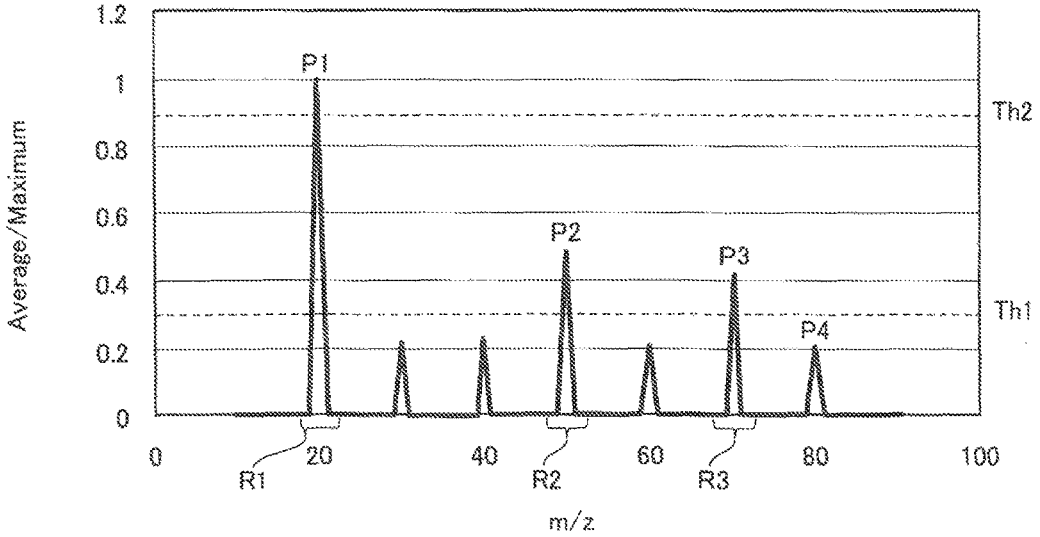
FIG. 6 is a diagram illustrating an intensity ratio spectrum indicating an intensity ratio of the average mass spectrum to the maximum mass spectrum.

In step S4, the data analysis unit 13 creates an intensity ratio spectral Save/max, which indicates an intensity ratio of the average mass spectrum Save to the maximum mass spectrum Smax. As illustrated in FIG. 6, the intensity ratio spectrum Save/max is a spectrum obtained by dividing the average mass spectrum Save by the maximum mass spectrum Smax. The vertical axis of FIG. 6 denotes a ratio of a detected intensity of the average mass spectrum Save to a detected intensity of the maximum mass spectrum Smax, that is, a detected intensity ratio (Average/Maximum). Note that the display unit 19 is caused by the control unit 11 to display the intensity ratio spectrum Save/max created by the data analysis unit 13.

As illustrated in FIG. 6, in the intensity ratio spectrum Save/max, the detected intensity ratio (Average/Maximum) of the peak P1 that appears in almost all the original mass spectra S(x, y) is close to 1. Since the peak P1 has a large value also in the maximum mass spectrum Smax illustrated in FIG. 5, the peak P1 is determined to be a substance that constitutes a matrix of the sample.

The detected intensity ratios (Average/Maximum) of the peaks P2 and P3 that appear in some of the original mass spectra S(x, y) are moderate values smaller than 1. In particular, as for the peak P3 that appears in some of the original mass spectra S(x, y) and originally has a low intensity, it is difficult to distinguish the peak P3 from noise in the average mass spectrum Save illustrated in FIG. 4 and the maximum mass spectrum Smax illustrated in FIG. 5; however, the peak P3 distinguishably appears to have a moderate detected intensity ratio (Average/Maximum) in the intensity ratio spectrum Save/max illustrated in FIG. 6.

In contrast, the peak P4 that appears only in a very small number of original mass spectra S(x, y) has a small detected intensity ratio (Average/Maximum). Accordingly, peaks that appear only in some of the original mass spectra S(x, y) are easily distinguishable by focusing on the peaks P2 and P3 that have moderate detected intensity ratios (Average/Maximum).

Step S5

In step S5, the data analysis unit 13 selects a peak in a range of a threshold that is set for the intensity ratio spectrum Save/max and specifies a mass range including the selected peak as a mass range used for creating data.

In this step, the data analysis unit 13 first sets a threshold for the intensity ratio spectrum Save/max. As the threshold, at least a lower threshold Th1 is set. Further, an upper threshold Th2 may be additionally set. The lower threshold Th1 and the upper threshold Th2 are values that are set and input with the operation unit 17 by the operator by checking the intensity ratio spectrum Save/max on the display unit 19.

Among the thresholds, the lower threshold Th1 is set to a value so that noise around the baseline is eliminated. On the other hand, the upper threshold Th2 is set to a detected intensity ratio (Average/Maximum) that is smaller than 1 so that a substance that constitutes a matrix of the sample and a substance that is evenly distributed throughout the two-dimensional range A are eliminated. It is determined whether the eliminated substance is a substance that constitutes a matrix of the sample on the basis of the maximum mass spectrum Smax illustrated in FIG. 5.

Note that the lower threshold Th1 and the upper threshold Th2 are not limited to such settings. For example, the lower threshold Th1 and the upper threshold Th2 may be values that are set so that the number of peaks having a peak value located in a range from the lower threshold Th1 to the upper threshold Th2 is less than or equal to a specified certain number. Alternatively, the lower threshold Th1 and the upper threshold Th2 may be values that are previously set without checking the intensity ratio spectrum Save/max.

In the case where the lower threshold Th1 alone is set, the peaks P1, P2, and P3 in a range of the lower threshold Th1 are selected from the intensity ratio spectrum Save/max. Ranges of mass-to-charge ratios (m/z) including these peaks P1, P2, and P3 are respectively specified as mass ranges R1, R2, and R3 of substances of interest for which distribution information is to be created. Herein, a peak in the range of the lower threshold Th1 may be either a peak exceeding the lower threshold Th1 or a peak greater than or equal to the lower threshold Th1. Herein, the mass ranges R1, R2, and R3 are set to, for example, ranges that include peak widths (e.g., half-widths) having the peaks P1, P2, and P3 at the center, respectively.

In the case where the upper threshold Th2 is set together with the lower threshold Th1, the peaks P2 and P3 in a range of the upper threshold Th2 are further selected from among the peaks P1, P2, and P3 selected based on the range of the lower threshold Th1. Ranges of the mass-to-charge ratios (m/z) including these peaks P2 and P3 are respectively specified as the mass ranges R2 and R3 of substances of interest for which distribution information is to be created. Herein, a peak in the range of the upper threshold Th2 may be either a peak smaller than the upper threshold Th2 or a peak smaller than or equal to the upper threshold Th2.

Note that in the case where the upper threshold Th2 is set, peaks for a substance that constitutes a matrix of the sample and a substance that is evenly distributed throughout the two-dimensional range A are eliminated; however, in the case where it is not necessary to eliminate the peaks for these substances, the upper threshold Th2 need not be set.

Step S6

In step S6, the data analysis unit 13 extracts peak intensities in the mass ranges R2 and R3 specified in step S5 from the original mass spectra S(x, y) and creates data in which each of the extracted intensities is associated with the position information (x, y) of the corresponding analysis-target area A(x, y). Herein, peak intensities in the specified mass ranges R2 and R3 are extracted from the original mass spectra S(x, y) each associated with the position information (x, y) of the corresponding analysis-target area A(x, y), and mapping data is created in which each of the extracted peak intensities is associated with the position information (x, y) of the corresponding analysis-target area A(x, y). The mapping data is created, for each of the specified mass ranges R2 and R3, as data indicating the distribution information of the mass range. Note that such mapping data is created in accordance with a mass imaging program.

Figure 7:
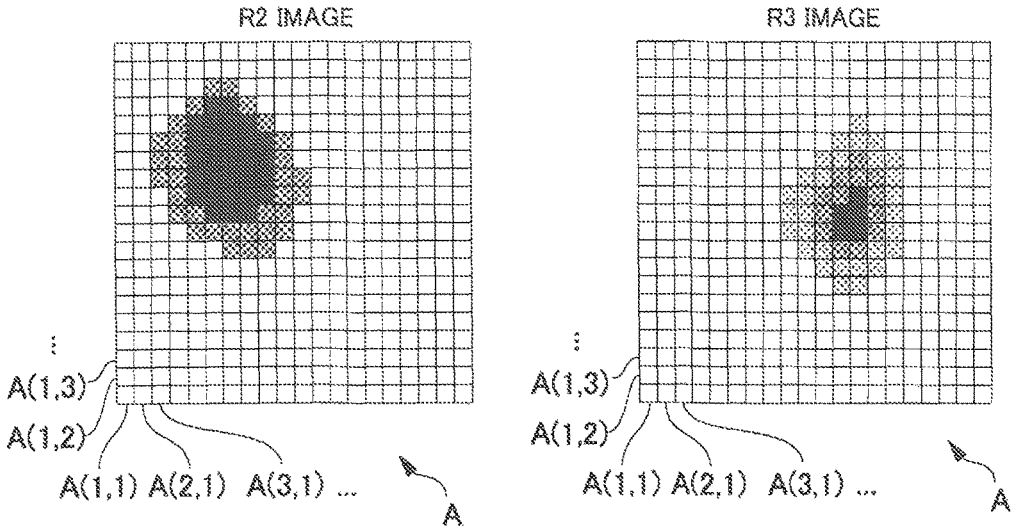
FIG. 7 is a diagram of mass imaging in which a peak intensity in a specified mass range is mapped.

FIG. 7 illustrates diagrams representing, in a heat map format, mapping data of the mass range R2 and mapping data of the mass range R3 thus created. These diagrams are diagrams of mass imaging (R2 image and R3 image) obtained by assigning different colors to the peak intensities of the specified mass ranges R2 and R3 and mapping the peak intensities at the corresponding analysis-target areas A(x, y) obtained by dividing, with a grid, the given two-dimensional range A to be analyzed. The diagrams illustrate distribution states of substances corresponding to the mass ranges R2 and R3.

Advantageous Effects of Embodiment

According to the embodiment described above, a vast number of original mass spectra S(x, y) obtained by two-dimensional mass spectrometry is processed, and the above-described intensity ratio spectrum Save/max is created.

In this intensity ratio spectrum Save/max, the peak P4 that appears very locally only in a very small number of original mass spectra S(x, y) can be made substantially as low as the level of ordinary baseline noise. On the other hand, in the intensity ratio spectrum Save/max, the detected intensity ratio (Average/Maximum) of the peak P1 that appears in almost all the original mass spectra S(x, y) can be made close to 1.

Accordingly, by setting the appropriate lower threshold Th1 for this intensity ratio spectrum Save/max, the peak P4 that is highly likely to be spike noise can be excluded from substance-of-interest candidates. Further, by setting the appropriate upper threshold Th2 for this intensity ratio spectrum Save/max, the peak P1 that is highly likely to be a substance that constitutes a matrix can be excluded from the substance-of-interest candidates.

As a result, it becomes easier to narrow the substances of interest, for which mapping data is to be created from the plurality of original mass spectra S(x, y) obtained by two-dimensional mass spectrometry, down to the peaks P2 and P3 related to substances that are unevenly distributed in the two-dimensional range A. In addition, since it becomes easier to eliminate noise based on a range selected in narrowing, without increasing the time taken for analysis of each analysis-target area A(x, y), the entire analysis time taken for two-dimensional mass spectrometry can also be reduced.

Having thus described our invention with the detail and particularity required by the Patent Laws, what is desired protected by Letters Patent is set forth in the following claims.

The invention claimed is:

1. A two-dimensional mass spectrometry apparatus for mass imaging and displaying a noise reduced image, comprising:

an analyzer unit that performs mass spectrometry for each of a plurality of analysis-target areas within a given two-dimensional range set on a sample to detect individual ions of the sample separated according to mass-to-charge ratios thereof;

a data analysis unit that converts detection signals of the ions in each of the plurality of analysis-target areas detected by the analyzer unit into mass spectra, wherein the mass spectra comprise a mass spectrum of each of the plurality of analysis-target areas and causes a storage unit to store the obtained mass spectra in association with position information of each of the plurality of analysis-target areas, and performs processing for mass imaging, based on the stored mass spectra;

an operation unit and, a display unit that displays a processing result by the data analysis unit, wherein the data analysis unit:

creates an average mass spectrum that is an average of the mass spectra stored in the storage unit, extracts, for respective ranges of the mass-to-charge ratios, respective highest peaks by comparing the mass spectrum of each of the plurality of analysis-target areas stored in the storage unit with one another, and creates a maximum mass spectrum constituted using the extracted highest peaks, and creates an intensity ratio spectrum indicating an intensity ratio of the average mass spectrum to the maximum mass spectrum, wherein the operation unit:

determines a lower intensity threshold based on the intensity ratio spectrum, below which lower intensity threshold peaks of the intensity ratio spectrum correspond to noise data, wherein the display unit displays the intensity ratio spectrum above the lower intensity threshold created by the data analysis unit.

2. A mass spectrometry data processing method for performing noise reduction processing for mass imaging, based on a mass spectrum of each of a plurality of analysis-target areas within a two-dimensional range set on a sample, comprising:

obtaining ion intensities for each of a plurality of analysis-target areas within the two-dimensional range set on the sample as mass spectra, wherein the mass spectra comprise a mass spectrum of each of the plurality of analysis-target areas, where each mass spectrum of each of the plurality of analysis-target areas is obtained by performing mass spectrometry for each of the plurality of analysis-target areas within the two-dimensional range set on the sample;

storing the mass spectra in association with position information of each of the plurality of analysis-target areas;

creating an average mass spectrum by averaging the stored mass spectra;

extracting, for each respective ranges of the mass-to-charge ratios, respective highest peaks by comparing the stored mass spectrum of each of the plurality of analysis-target areas with one another, and creating a maximum mass spectrum constituted using the extracted highest peaks;

creating an intensity ratio spectrum indicating an intensity ratio of the average mass spectrum to the maximum mass spectrum;

determining a lower intensity threshold for the intensity ratio spectrum, below which lower intensity threshold peaks of the intensity ratio spectrum correspond to noise data; and displaying the intensity ratio spectrum above the lower intensity threshold.

3. A mass spectrometry data processing method for performing noise reduction processing for mass imaging based on a mass spectrum of each of a plurality of analysis-target areas within a two-dimensional range set on a sample, comprising:

obtaining ion intensities of the sample for each of a plurality of analysis-target areas as mass spectra, wherein the mass spectra comprise a mass spectrum of each of the plurality of analysis-target areas, wherein each mass spectrum of each of the plurality of analysis-target areas is obtained by performing mass spectrometry for each of the plurality of analysis-target areas;

storing the mass spectra in association with position information of each of the plurality of analysis-target areas;

creating an average mass spectrum by averaging the stored mass spectra;

extracting, for respective ranges of the mass-to-charge ratios, respective highest peaks by comparing the stored mass spectrum of each of the plurality of analysis-target areas with one another, and creating a maximum mass spectrum constituted using the extracted respective highest peaks;

creating an intensity ratio spectrum indicating an intensity ratio of the average mass spectrum to the maximum mass spectrum;

setting a threshold for the intensity ratio spectrum;

selecting peaks in a range of the threshold and specifying ranges of the mass-to-charge ratios that include the selected peaks;

extracting peak intensities in the specified ranges of the mass-to-charge ratios from the mass spectra stored in association of position information of each of the plurality of analysis-target areas; and creating, for respective specified ranges of the mass-to-charge ratios, mapping data associating the extracted peak intensities with the position information of each of the plurality of analysis-target areas.

4. The method according to claim 3, wherein in the setting of the threshold, a lower threshold is set as the threshold wherein in the setting of the threshold, the threshold is set at a value not including a peak of a noise signal in the range of the threshold.

5. The method according to claim 4, wherein an upper threshold is further set as the threshold wherein an upper threshold is further set at a value not including, in a range of the upper threshold, a peak relating to a substance that constitutes a matrix of the sample and/or a substance that is evenly distributed throughout the two-dimensional range.

* * * * *